US005390613A

United States Patent [19]

Shibata

[11] Patent Number: 5,390,613

[45] Date of Patent: Feb. 21, 1995

[54] MULTI-NEEDLE EMBROIDERING MACHINE WITH THREAD COLOR CHANGING MECHANISM

[75] Inventor: Masanori Shibata, Ichinomiya, Japan

[73] Assignee: Kabushikikaisha Barudan, Ichinomiya, Japan

[21] Appl. No.: 145,165

[22] Filed: Nov. 3, 1993

[30] Foreign Application Priority Data

Jun. 29, 1993 [JP] Japan ..... 5-186932

[51] Int. Cl.[6] ..... D05C 11/16

[52] U.S. Cl. ..... 112/80.43; 112/163

[58] Field of Search ..... 112/80.41, 80.44, 80.43, 112/98, 99, 100, 155, 167, 163, 121.11

[56] References Cited

U.S. PATENT DOCUMENTS

| | | | |
|---|---|---|---|
| 3,118,403 | 1/1964 | Chambers | 112/80.43 |
| 4,075,958 | 2/1978 | Sacchetti | 112/163 |
| 4,295,433 | 10/1981 | Desprez et al. | 112/98 X |
| 4,386,572 | 6/1987 | Slomma | 112/163 X |
| 4,473,018 | 9/1984 | Shimoda et al. | 112/163 |
| 4,531,467 | 7/1985 | Golia et al. | 112/163 X |
| 4,924,789 | 5/1990 | Tajima et al. | 112/155 X |

FOREIGN PATENT DOCUMENTS

| | | | |
|---|---|---|---|
| 55-008626 | 3/1980 | Japan . | |
| 1299589 | 12/1989 | Japan | 112/163 |

*Primary Examiner*—Clifford D. Crowder
*Assistant Examiner*—Ismael Izaguirre
*Attorney, Agent, or Firm*—Cushman, Darby & Cushman

[57] ABSTRACT

A multi-needle embroidering machine having a plurality of heads each carrying a plurality of needles for feeding differently colored threads has a color (i.e. thread) changing mechanism provided in each head for selecting a particular needle to be driven to feed a differently colored thread. An assembly for driving the color changing mechanism is incorporated in one head. The color changing mechanism in the one head and those that do not have a driving assembly are connected to each other by a rod, or rods which transmit a driving force from the former to the latter.

12 Claims, 11 Drawing Sheets

MULTI-NEEDLE EMBROIDERING MACHINE WITH THREAD COLOR CHANGING MECHANISM

BACKGROUND OF THE INVENTION

1. Field of the Invention

This invention relates to a multi-needle embroidering machine having a plurality of needles at its head, and more particularly, to a multi-needle embroidering machine having a plurality of machine heads, and a mechanism for changing a thread to a differently colored one at each machine head.

2. Description of Related Art

FIG. 10 shows a conventional two-head multi-needle embroidering machine 50 having two juxtaposed machine heads 51A and 51B. It has a controller 52 which inputs information on a design to be embroidered, a driver unit 53 which analyzes the inputted information to prepare one-needle data as known in the art, a plurality of needles 54 of which one is selected in accordance with the one-needle data so that a particular embroidery thread may be selected, and a spindle of which the rotation is transmitted through a crank mechanism to cause the selected needle 54 to move vertically to stitch the design to be embroidered. The motion of an embroidery frame 56 which is movable in the directions X and Y along a table 55 is so controlled as to be synchronous with the vertical motion of the needle 54. A plurality of embroidery threads differing from one another in color, etc. are appropriately changed for selective use to embroider a desired pattern. The changing of the threads is effected by selecting an appropriate one from the needles 54. The two machine heads 51A and 51B are connected by two rods 57 and 58 to effect the changing of the threads simultaneously.

FIG. 11 shows a color changing mechanism employed in the embroidering machine 50 for effecting the changing of the threads. It includes a needle mounting member 59 provided with a crank mechanism, and a rotary disk 60 connected to the needle mounting member 59 horizontally rotatably. The rotary disk 60 has a plurality of appropriately spaced apart recesses 60*a* formed on its peripheral edge, and carries thereon a needle bar holding member 60*b* holding the needles vertically movably. A needle mechanism is not shown in FIG. 11. The rotary disk 60 is fitted with a bearing 61 and a sealing metal ring 62 which are fitted to the needle bar holding member 60*b*, a thrust bearing outer race 63, a thrust bearing 64 and a thrust washer 68 which are fitted between the needle mounting member 59 and the rotary disk 60, and a bearing 61, a thrust bearing outer race 63, a thrust bearing 64 and a lower end member 65 for a drive shaft which are fitted under the rotary disk 60. A connecting arm 66 extends radially outwardly from the rotary disk 60, and has a free end provided with a joint pin 67. The rod 58 is connected by a connecting member 71 and a holding screw 72, and is connected to the joint pin 67 by a uni-ball joint 73 and a nut 74. The rod 58 is movable to cause the rotation of the rotary disk 60.

The rotation of the rotary disk 60 is restricted by a lock lever 80. The lock lever 80 is mounted on the needle mounting member 59 by a bracket 81 to which it is rotatably attached by a shaft 82, a bolt 83 and a nut 84. The lock lever 80 has at one end thereof a projection 80*a* which is engageable with any of the recesses 60*a* of the rotary disk 60, while a rod clamp 85 is attached to the other end thereof by a nut 87. The rod 57 is movable to cause the rotation of the lock lever 80. The rod 57 is connected by a connecting member 88 and a holding screw 89, and is connected to the rod clamp 85 by a holding screw 86. The lock lever 80 is normally urged toward the needle mounting member 59 by a pin 90 and a spring 91. The drive shaft 92 extends vertically through the needle mounting member 59, and is fitted with an upper end member 93 for the drive shaft. The needle unit as a whole (not shown) is rotatable about the drive shaft 92.

As long as a selected needle continues its vertical motion to make stitches, the projection 80*a* remains in engagement with one of the recesses 60*a*, and the rotary disk 60, therefore, remains locked against rotation. When it has become necessary to change the needle to feed a differently colored thread, a needle changing motor and a solenoid installed behind the controller 52, though not shown, are driven to move the rod 57 and rotate the lock lever 80 to unlock the rotary disk 60, as well as moving the rod 58 by an appropriate distance to rotate the rotary disk 60 to an appropriate extent. Upon completion of the rotation of the rotary disk 60, the lock lever 80 is rotated in the opposite direction to engage its projection 80*a* with another recess 60*a* and thereby lock the rotary disk 60 again. The appropriate selection of the needles is repeated to effect the necessary changing of differently colored threads. The rods 57 and 58 are connected to the rotary disks 60 and the lock levers 80 in both of the machine heads 51A and 51B, so that the two machine heads 51A and 51B may effect the simultaneous selection of similar needles for changing the threads.

The needle changing motor and solenoid employed in the conventional multi-needle embroidering machine for driving the rods 57 and 58 to change the embroidery threads are installed near the controller 52 at one end of the table 55. The table 55 has to be sufficiently large to enable the controller 52 to allow the free movement of the embroidery frame 56 throughout any embroidering operation, and the rods 57 and 58 have, therefore, to be sufficiently long. The rods 57 and 58 have to be so long as to bring about a number of problems, as pointed out below:

(1) The rods 57 and 58 vibrate heavily, and cause the needle bars and thereby the needles to vibrate so heavily that threads are easily broken;

(2) The vibration of the rods 57 and 58 makes a large noise which worsens the environment in which the machine is used; and (3) The rods 57 and 58 hinders work, particularly on the table 55 in the area which is farther than the rods.

SUMMARY OF THE INVENTION

It is, therefore, an object of this invention to provide a multi-needle embroidering machine having a color changing mechanism including rods or like means for transmitting a driving force which are sufficiently small in length as to be less likely to vibrate and cause thread breakage or make noise, as well as improving the ease of work on a table.

This object is attained by a multi-needle embroidering machine which comprises a plurality of machine heads each carrying a plurality of needles; a color changing mechanism provided in each head for selecting one of the needles to be driven to feed an embroidery thread having a desired color, a driving means incorporated in at least one of the heads and connected to the color changing mechanism for driving it, and a means for transmitting a driving force by which the color changing mechanism in the at least one head with the driving means is connected to the color changing mechanism in any other head without the driving means.

This invention eliminates the necessity for installing the means for driving the color changing mechanism at one end of a table, and thereby enables a reduction in length of the rod, or like means for transmitting a driving force. The shortened transmitting means is less likely to vibrate and cause thread breakage, or make noise, as well as improving the ease of work on the table. It is a great advantage from an economical standpoint that the driving means incorporated in one of the heads can be used to drive the color changing mechanism in any other head, too.

The color changing mechanism typically comprises a needle unit including a plurality of needles, and a device for supporting the needle unit movably in either direction in a horizontal plane. The needle unit may, for example, include a plurality of appropriately spaced apart needles arranged in an arcuate line, while the supporting device supports it rotatably in either direction in a horizontal plane. Alternatively, the needle unit may include a plurality of appropriately spaced apart needles arranged in a straight line, while the supporting device supports it movably in either direction along a straight path in a horizontal plane.

The color changing mechanism is preferably provided with a device for locking the needle unit against movement in a desired position.

The driving means may, for example, comprise a motor and a device for transmitting the rotation of the motor to rotate the needle unit in either direction in a horizontal plane. The motor is preferably mounted at the upper portion of the machine head. The rotation transmitting device may, for example comprise a combination of gears.

The driving means may alternatively comprise a motor and a device for converting the rotation of the motor to a straight-line motion to move the needle unit in either direction along a straight path in a horizontal plane. The motor is preferably mounted at the upper portion of the machine head. The converting device may, for example, comprise a combination of gears. The converting device may alternatively comprise a rotatable helical grooved cam and a plurality of cam followers which are moved along a straight line by the cam.

Other examples of the driving means include a rotary solenoid and a fluid cylinder.

The device for transmitting a driving force may, for example, comprise a rod.

Other and further objects of this invention will become obvious upon an understanding of the illustrative embodiments about to be described or will be indicate in the appended claims, and various advantages not referred to herein will occur to one skilled in the art upon employment of the invention in practice.

DETAILED DESCRIPTION OF THE PREFERRED EMBODIMENTS

A two-head multi-needle embroidering machine according to a first embodiment of this invention will now be described with reference to FIGS. 1 to 6.

Figure 1:
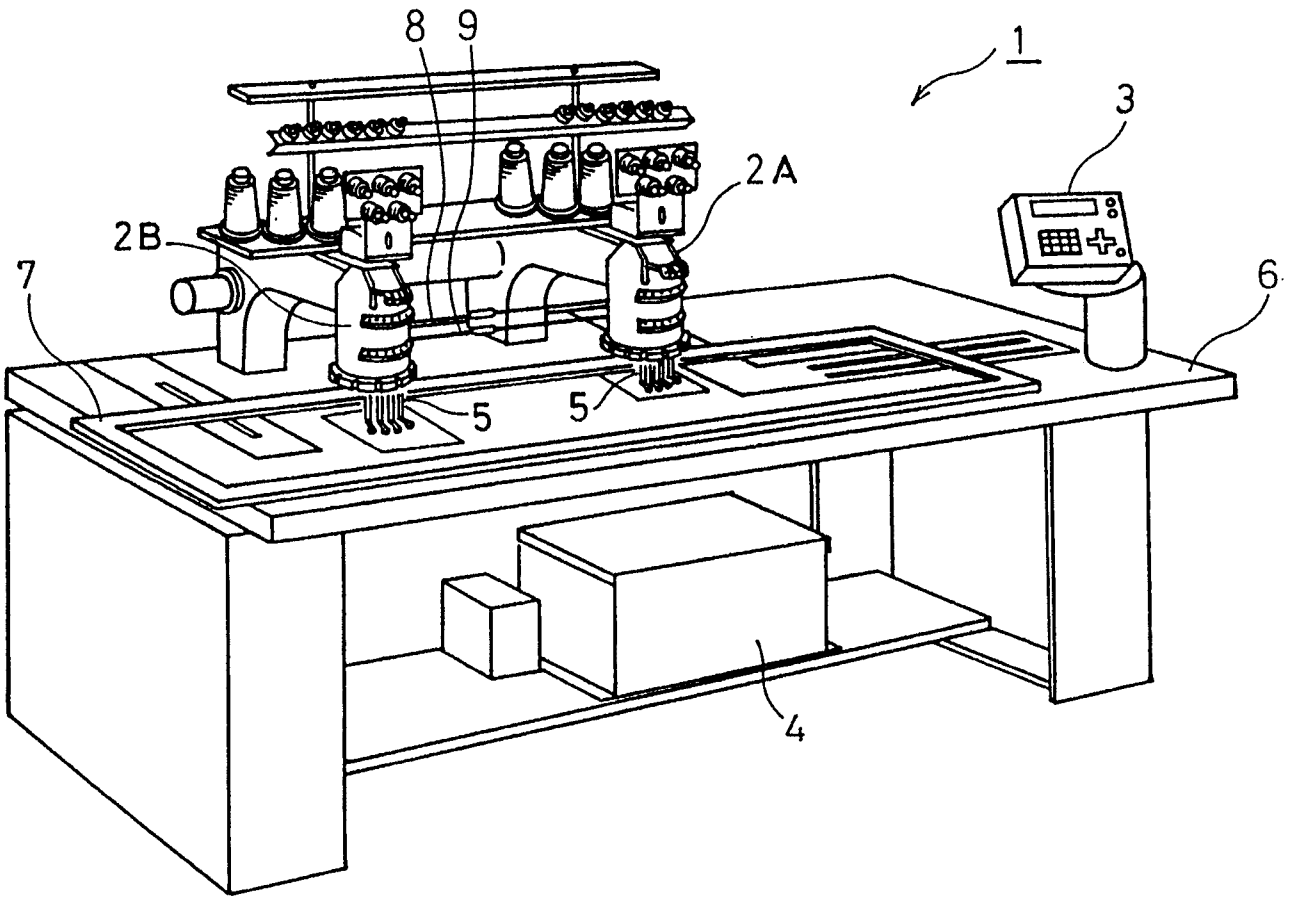
FIG. 1 is a perspective view showing the general construction of a multi-needle embroidering machine according to a first embodiment of this invention.
Figure 2:
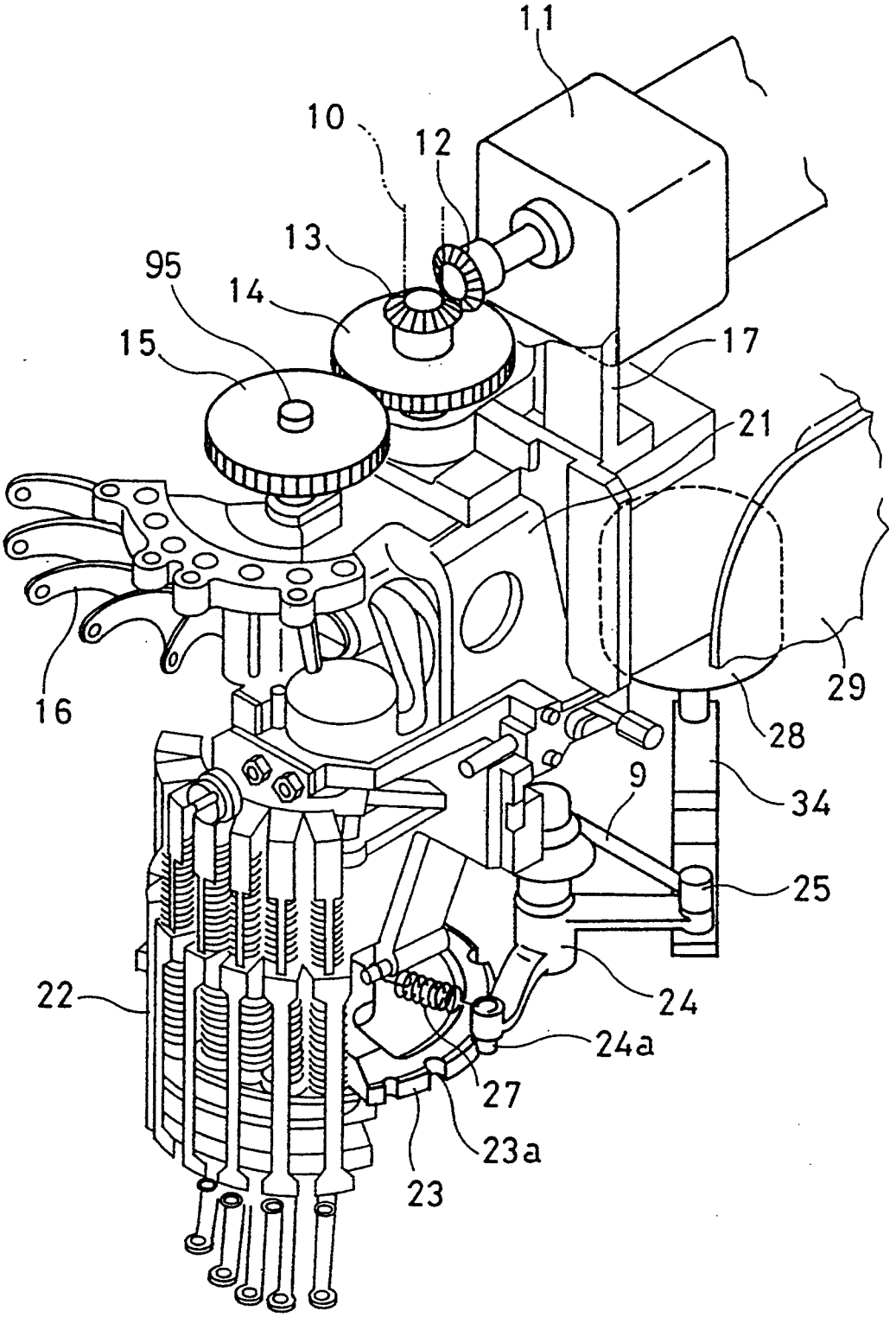
FIG. 2 is an enlarged fragmentary perspective view of the machine showing, among others, a color changing mechanism.
Figure 5:
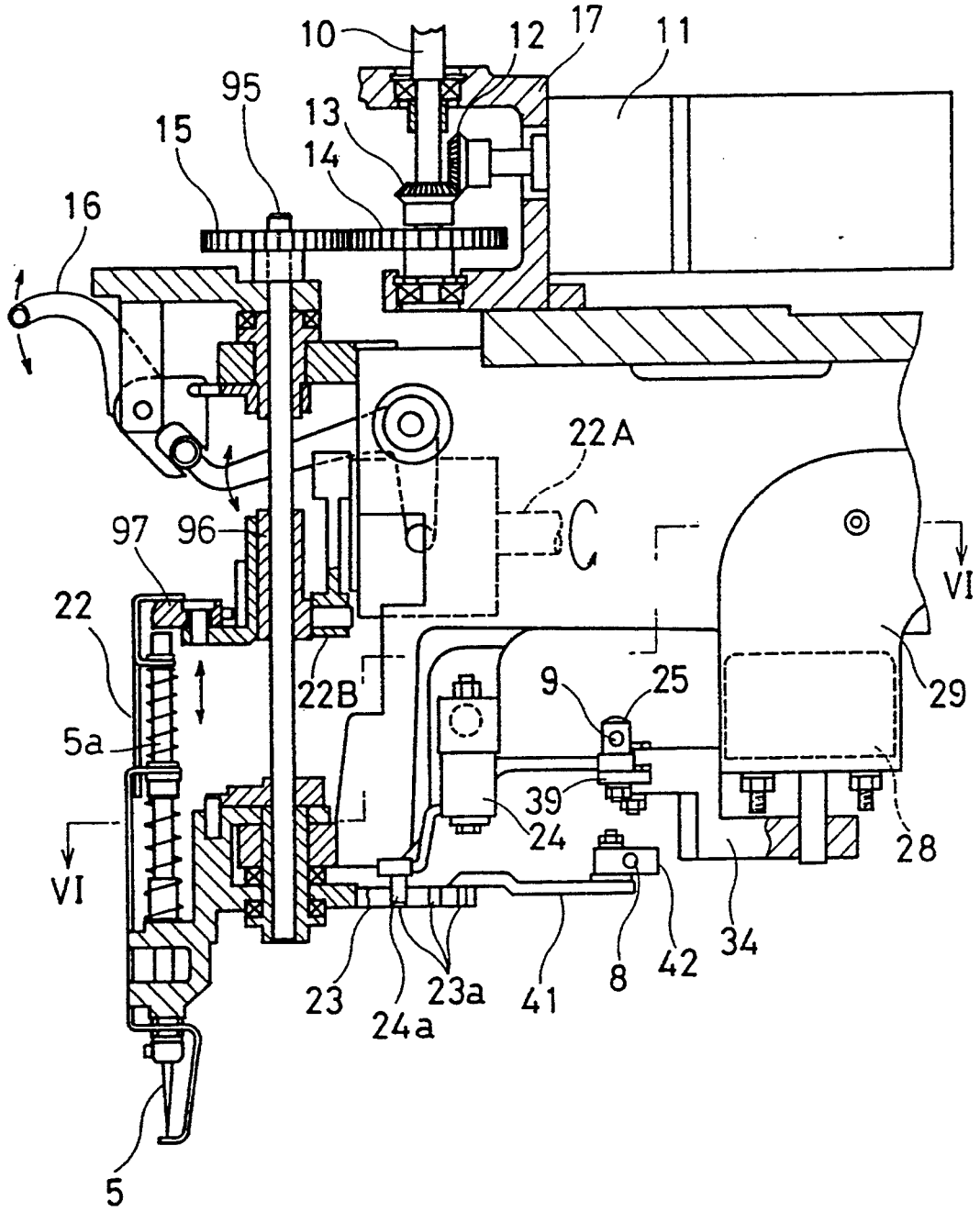
FIG. 5 is a side elevational view, partly in section, of the color changing mechanism.

The machine is generally shown at 1 in FIG. 1, and has two juxtaposed machine heads 2A and 2B each carrying a plurality of needles 5. It further includes a controller 3 which inputs information on a design to be embroidered, a driver unit 4 which analyzes the inputted information to prepare one-needle data as known in the art so that one of the needles 5 in accordance with the one-needle data may be selected to feed a particular embroidery thread, and a spindle 22A of which the rotation is transmitted through a crank mechanism 22B to cause the selected needle 5 to move vertically to stitch the design to be embroidered, as shown in FIG. 5. The motion of an embroidery frame 7 which is movable in the directions X and Y along a table 6 is so controlled as to be synchronous with the vertical motion of the needle 5. A plurality of embroidery threads differing from one another in color, etc. are appropriately changed for selective use to embroider a desired pattern. The changing of the threads is effected by selecting an appropriate one from the needles 5, as is the case with the conventional machine.

Figure 6:
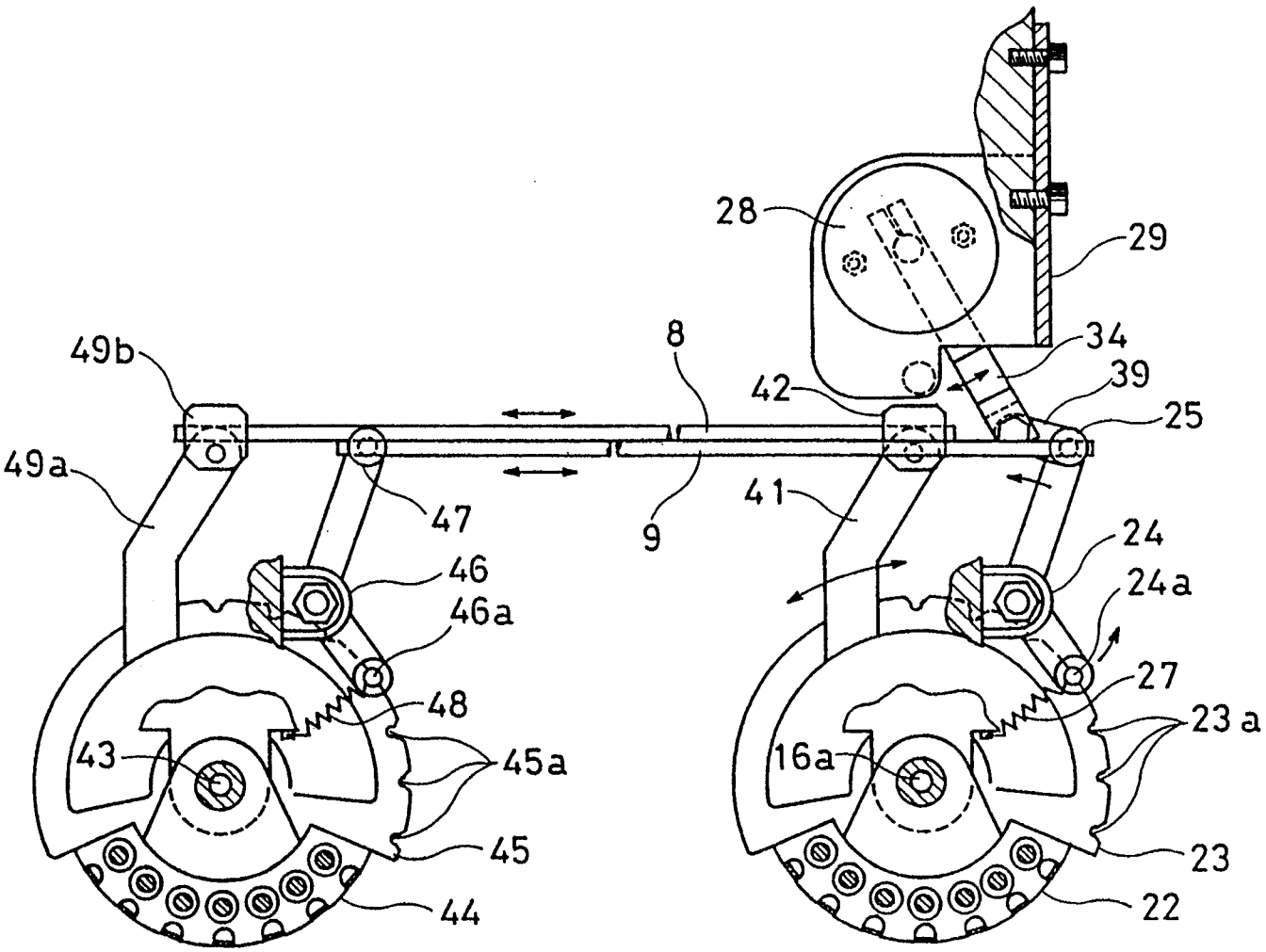
FIG. 6 is a sectional view taken along the line VI—VI of FIG. 5.

Description will now be made of the color (i.e. thread) changing mechanisms employed in the embroidering machine 1 with reference to FIGS. 2 to 6. The right head 2A is provided with a color changing mechanism and a driving means therefor which are shown in FIGS. 2 to 6, while the left head 2B is provided only with a color changing mechanism which is shown in FIG. 6. The color changing mechanisms in the heads 2A and 2B are connected together by two rods 8 and 9 employed as a means for transmitting a driving force to effect the changing of threads simultaneously.

The color changing mechanism in the right head 2A and the driving means therefor effect the changing of threads by rotating a needle unit to which rotation is transmitted from a turning shaft 10 through a combination of gears. A bevel gear 12 attached to the output shaft of a motor 11 meshes with a bevel gear 13 attached to the turning shaft 10, and a spur gear 14 attached to the turning shaft 10 meshes with a spur gear 15 attached to a guide rod 95. Accordingly, a driving force produced by the motor 11 is transmitted to the turning shaft 10 through the bevel gears 12 and 13, and to a thread takeup 16 through the spur gears 14 and 15 and the guide rod 95 to rotate the thread takeup 16 with the guide rod 95.

Figure 3:
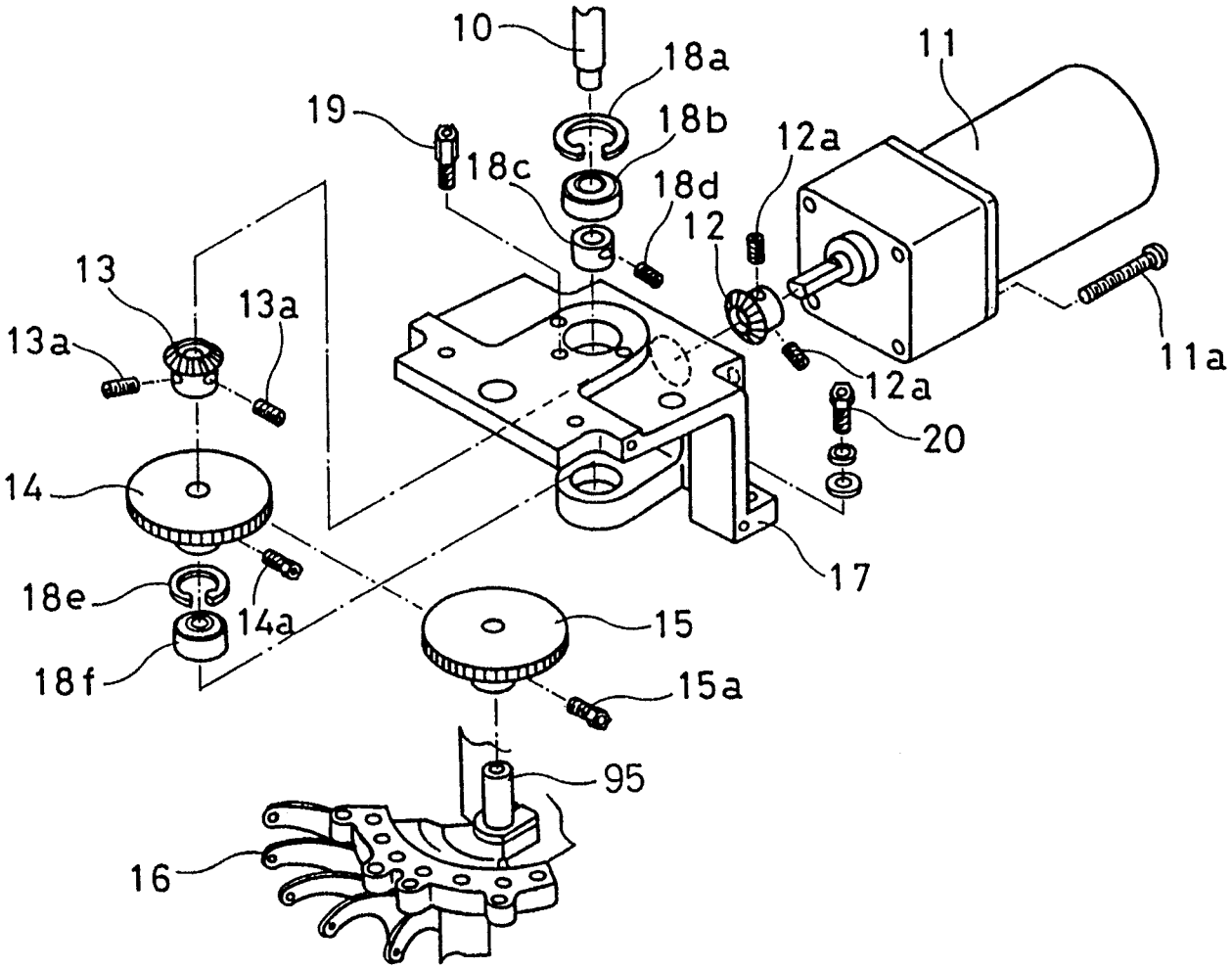
FIG. 3 is an exploded perspective view of the color changing mechanism.

The motor 11 is secured to a bracket 17 by screws 11*a*, and the bevel gear 12 is secured to the output shaft of the motor 11 by holding screws 12*a*, as shown in FIG. 3. The bevel gear 13 is secured to the turning shaft 10 by holding screws 13*a*, and the spur gear 14 by a bolt 14*a*. The spur gear 15 is secured to the guide rod 95 by a bolt 15*a*. A retaining ring 18*a*, a ball bearing 18*b* and a collar 18*c* are fitted about the turning shaft 10 above the bracket 17, and the collar 18*c* is secured by a holding screw 18*d*, while a retaining ring 18*e* and a ball bearing 18*f* are fitted about the turning shaft 10 below the spur gear 14. Needle base mounting screws 19 are threadedly connected with the bracket 17 which is secured to a needle mounting 21 by bolts 20.

The needle unit 22 is supported on the guide rod 95 below the thread takeup 16, and is rotatable in either direction with a rotary disk 23 upon rotation of the guide rod 95.

The needle unit 22 comprises a plurality of vertically disposed and horizontally spaced apart needle bars 5*a* arranged in an arcuate array. Each needle bar 5*a* is vertically movable, and carries a needle 5 at its lower end. A vertically movable member 96 is fitted about the guide rod 95, and is vertically movable with the rotation of a spindle 22A. An engaging member 97 is connected to the vertically movable member 96 to engage the upper end of one needle bar 5*a* selected by the rotation of the needle unit 22, so that only the selected needle bar 5*a* and the needle 5 thereby carried are allowed to move vertically.

The rotary disk 23 has a plurality of recesses 23*a* formed along its peripheral edge and spaced apart from one another by a distance equal to the spacing between every two adjoining needles. A lock lever 24 has a projection 24*a* which is engageable with one of the recesses 23*a*. A color, or needle changing lever 41 extends from the rotary disk 23, and has a free end to which a rod clamp 42 is connected. If the rotary disk 23 is rotated, the color changing lever 41 is also rotated to transmit its rotation to the left head 2B through the rod 8. The lock lever 24 is provided at its end remote from the projection 24*a* with a rod clamp 25 to which the rod 9 is secured by a holding screw 26. The lock lever 24 is normally urged toward the needle mounting 21 by a spring 27.

A rotary solenoid 28 is mounted by a bracket 29 on the rear bottom of the needle mounting 21, and has an output shaft to which a connecting lever 34 is attached. The connecting lever 34 is connected by a link plate 39 to the rod clamp 25 on the lock lever 24, so that upon actuation of the rotary solenoid 28, the connecting lever 34 may be rotated to rotate the lock lever 24 and thereby unlock the rotary disk 23. The driving force produced by the rotary solenoid 28 is also transmitted to the left head 2B through the connecting lever 34 and the rod 9.

Figure 4:
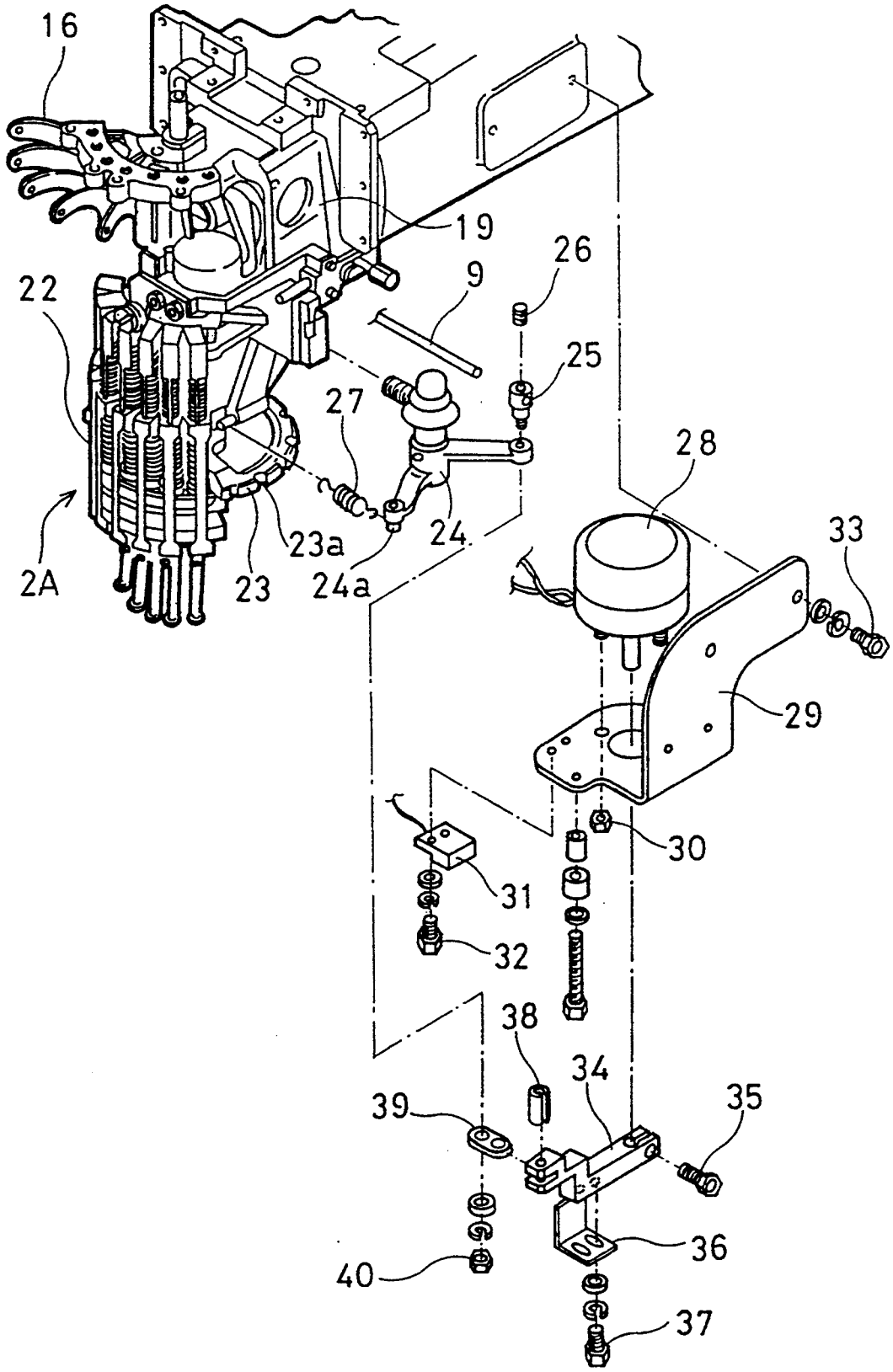
FIG. 4 is another exploded perspective view of the color changing mechanism.

The rotary solenoid 28 is secured to the bracket 29 by nuts 30, as shown in FIG. 4. A proximity switch 31 is secured to the bracket 29 by a bolt 32. The bracket 29 is secured to the head 2A by bolts 33. The connecting lever 34 is secured to the drive shaft of the rotary solenoid 28 by a bolt 35, and a sensor dog 36 is secured to the underside of the connecting lever 34 by a bolt 37. The link plate 39 is secured to the end of the connecting lever 34 by a spring pin 38, and to the rod clamp 25 on the lock lever 24 by a nut 40.

The projection 24*a* of the lock lever 24 remains in engagement with one of the recesses 23*a* of the rotary disk 23 to lock it against rotation as long as a selected needle continues its vertical motion to make stitches. When it has become necessary to change the needle to feed a differently colored thread, the rotary solenoid 28 is actuated to rotate the connecting lever 34 and the link plate 39 and thereby cause the lock lever 24 to rotate by overcoming the force of the spring 27 and thereby unlock the rotary disk 23. Then, the motor 11 is driven to transmit a driving force through the bevel gears 12 and 13, the spur gears 14 and 15 and the guide rod 95 to cause the thread takeup 16, the needle unit 22 and the rotary disk 23 to rotate together. The engaging member 97 engages the upper end of the needle bar 5*a* which has been selected as a result of the rotation of the needle unit 22, and only the selected needle bar 5*a* and the needle 5 thereby carried are, therefore, allowed to move vertically.

When the desired needle has been selected, the rotary solenoid 28 is deenergized, whereupon the lock lever 24 is rotated in the opposite direction, and its projection 24*a* engages another recess 23*a* to lock the rotary disk 23 again. The appropriate selection of the needles is repeated to effect the necessary changing of differently colored threads. The rotation of the connecting lever 34 is detected by the proximity switch 31 and the sensor dog 36.

The rod 9 having one end connected to the lock lever 24 by the rod clamp 25 is connected at the other end thereof to a lock lever 46 in the left head 2B by a rod clamp 47, as shown in FIG. 6. The left head 2B includes a needle unit 44 which is substantially identical in construction to the needle unit 22 in the right head 2A, and which is rotatable with a rotary disk 45 about a drive shaft 43. The rotary disk 45 has a plurality of recesses 45*a* formed along its peripheral edge and spaced apart from one another by a distance equal to the spacing between every two adjoining needles, and the lock lever 46 has a projection 46*a* which is engageable with one of the recesses 45*a*.

When the rotary solenoid 28 for the right head 2A is actuated to rotate the connecting lever 34 and the link plate 39 and thereby cause the lock lever 24 to rotate by overcoming the force of the spring 27, not only the rotary disk 23 for the right head 2A but also the rotary disk 45 for the left head 2B is unlocked, since the two lock levers 24 and 46 are connected to each other by the rod 9. That is, the rod 9 having one end connected to the lock lever 24 in the right head 2A by the rod clamp 25 is moved to cause the lock lever 46 to rotate through the rod clamp 47 for the left head 2B by overcoming the force of a spring 48 and thereby unlock the rotary disk 45.

A color changing lever 49*a* extends from the rotary disk 45 for the left head 2B, and has a free end to which the rod 8 is connected by a rod clamp 49*b*. Accordingly, the rod 8 which is connected to the color changing lever 41 by the rod clamp 42 is moved to cause the color changing lever 49*a* in the left head 2B and thereby the rotary disk 45 to rotate, too. Thus, the rotary disk 23 for the right head 2A and the rotary disk 45 for the left head 2B rotate simultaneously, so that the selection of needles and thereby threads may take place simultaneously at the right and left heads 2A and 2B to effect the necessary changing of differently colored threads.

Figure 10:
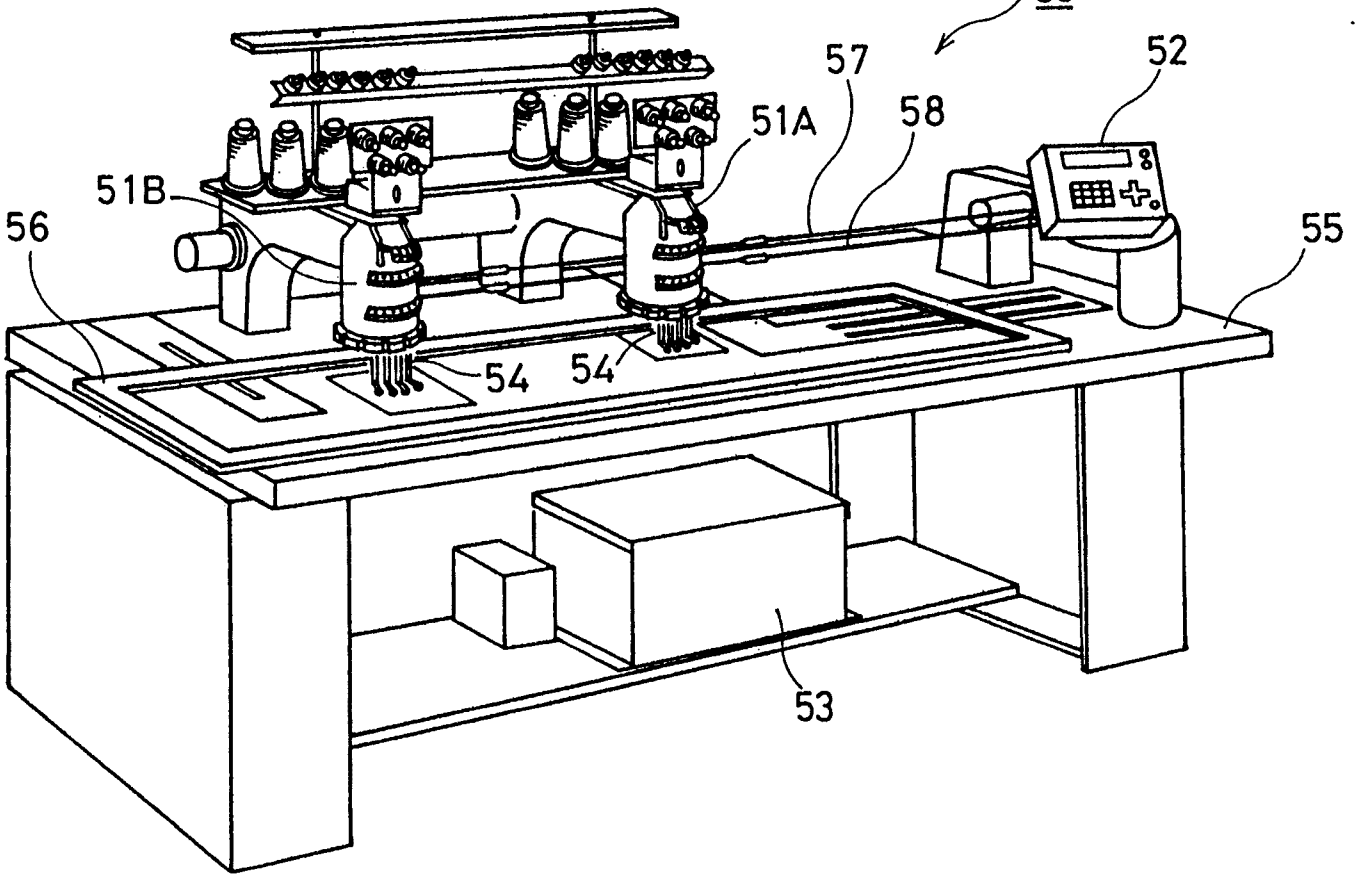
FIG. 10 is a perspective view showing the general construction of a conventional multi-needle embroidering machine.
Figure 11:
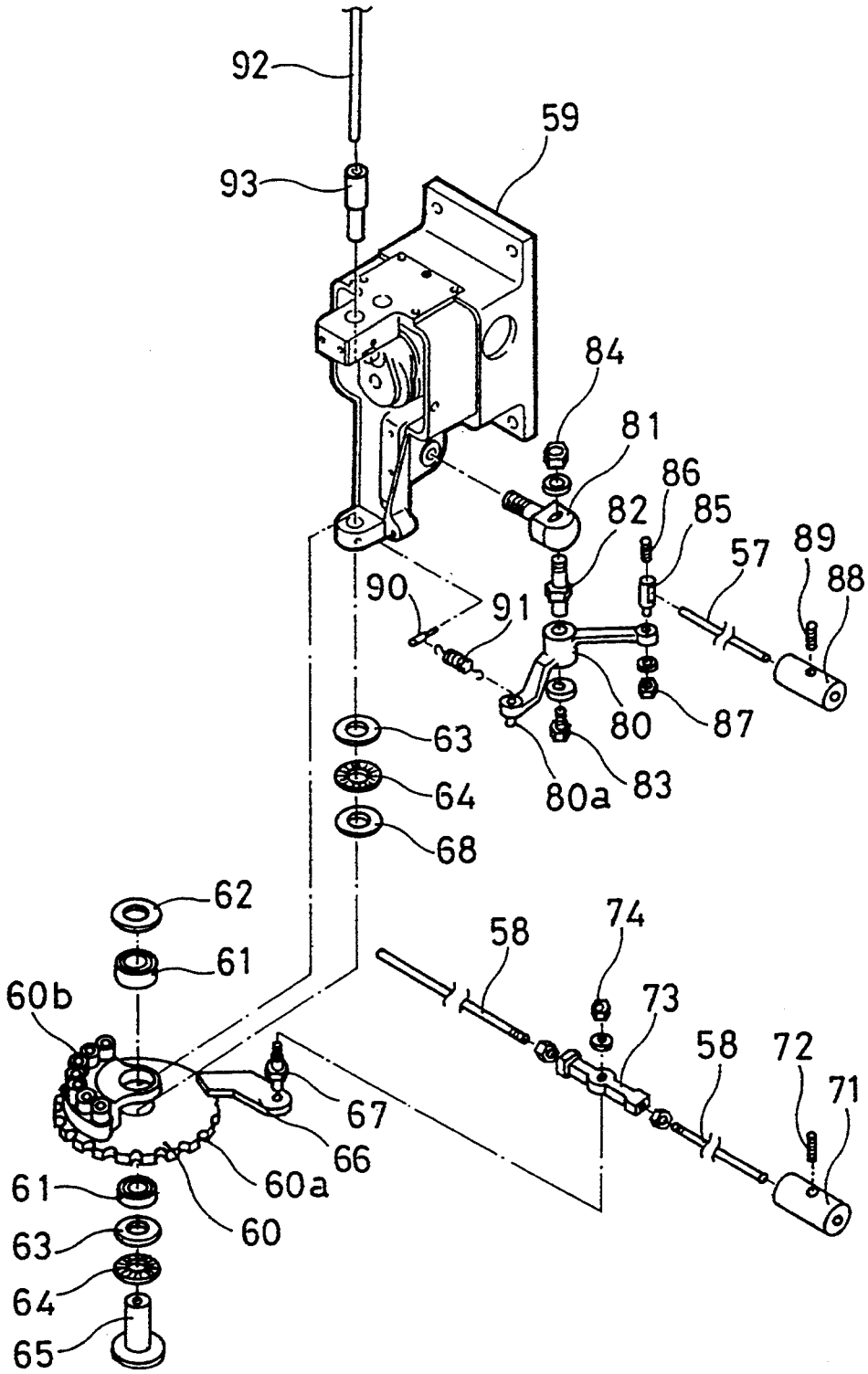
FIG. 11 is an exploded perspective view of the color changing mechanism in the conventional machine.

The means for driving the color changing mechanisms in the embroidering machine 1 of this invention, including the motor 11, bevel gears 12 and 13, spur gears 14 and 15, rotary solenoid 28, connecting lever 34, and lock lever 24, is incorporated in one (2A) of the two heads 2A and 2B, as hereinabove described. The color changing mechanisms in the two heads 2A and 2B are connected to each other by the rods 8 and 9. The means for driving the color changing mechanisms is not situated at the end of the table as shown in FIG. 10. Therefore, the rods 8 and 9 extend only between the two heads 2A and 2B, and are smaller in length than their counterparts shown in FIG. 10. The shortened rods 8 and 9 provide the following advantages:

(1) The rods 8 and 9 are less likely to vibrate, and make the needle bars and needles less likely to vibrate, and the threads less likely to break;

(2) The rods 8 and 9 make only a smaller noise due to vibration, thereby improving the environment in which the machine is used; and (3) The absence of any rod portion extending beyond the head 2A provides a larger free space which facilitates any work on or over the table 6 in that area.

The means for driving the color changing mechanisms is compactly incorporated at the upper portion of the head 2A, and hardly has any portion protruding from either side of the head 2A. The means is composed of a small number of parts, and does not call for any case housing the parts.

The driving means incorporated in the head 2A can be used for driving the color changing mechanisms in both of the heads 2A and 2B together, as they are connected by the rods 8 and 9. This is a great advantage from an economical standpoint.

Figure 7:
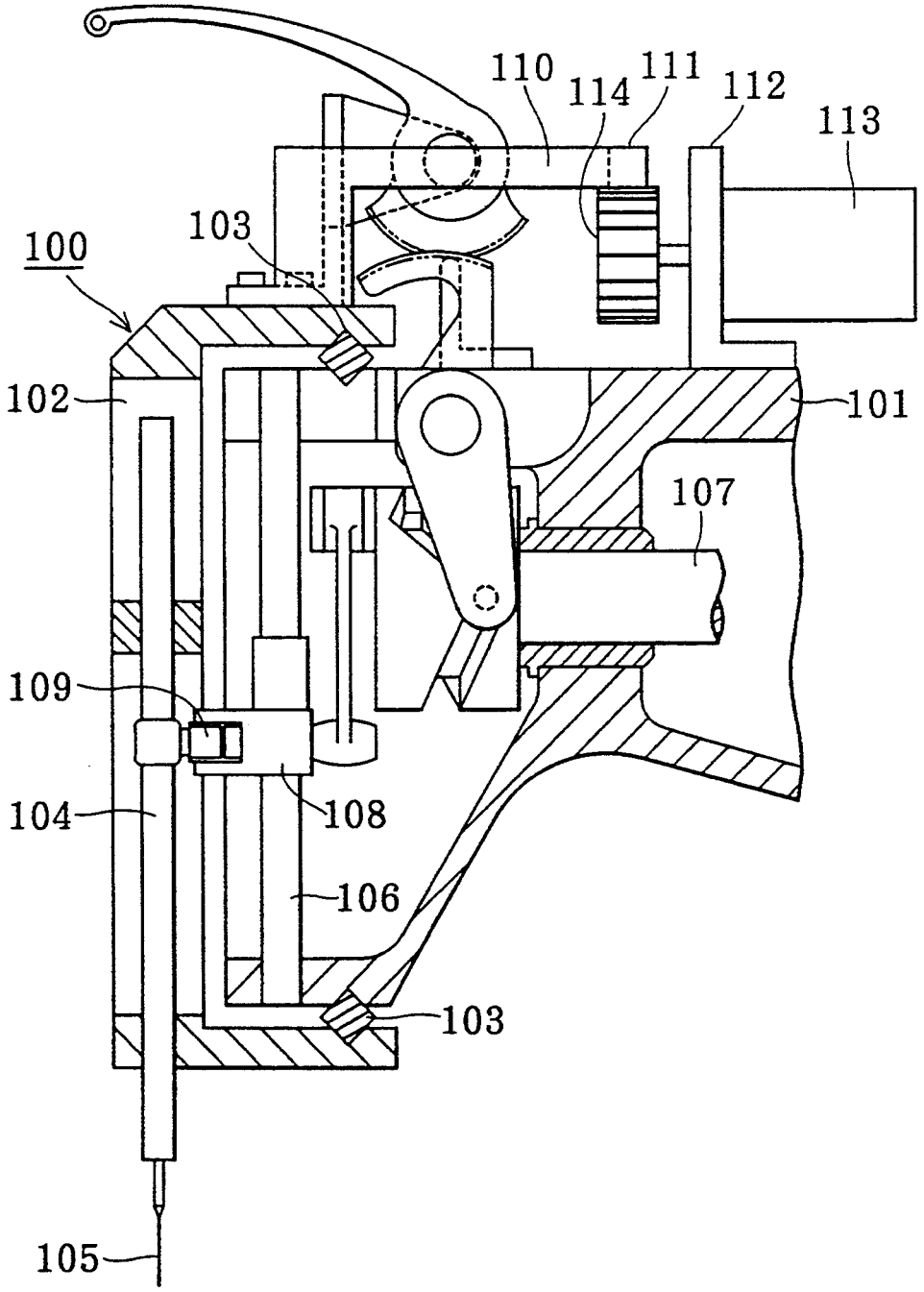
FIG. 7 is a side elevational view, partly in section, showing, among others, a color changing mechanism in a multi-needle embroidering machine according to a second embodiment of this invention.
Figure 8:
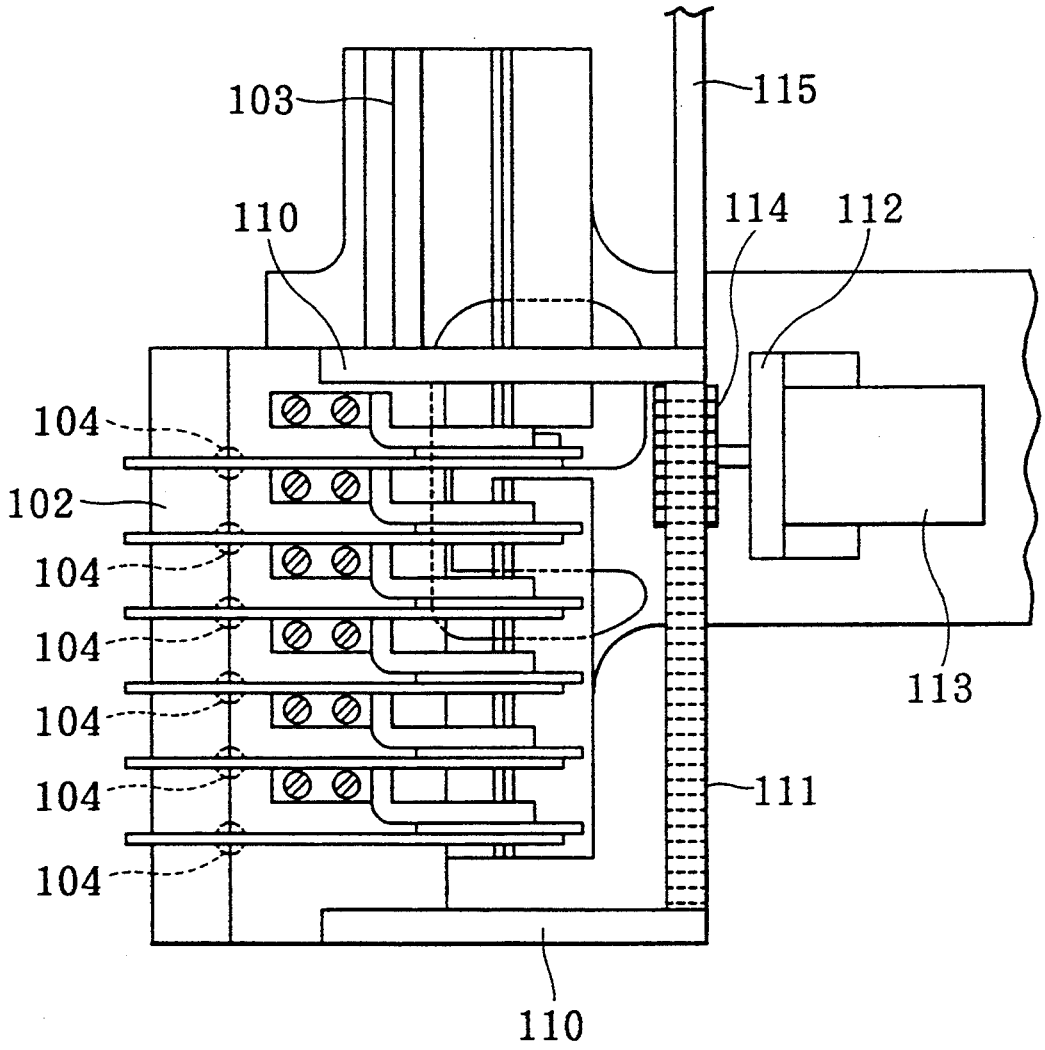
FIG. 8 is a top plan view of the color changing mechanism shown in FIG. 7.

Attention is now directed to FIGS. 7 and 8 showing a multi-needle embroidering machine according to a second embodiment of this invention. A color changing mechanism and a driving means therefor employed in this embodiment differs from those according to the first embodiment in that a needle unit has a plurality of spaced apart needles arranged in a straight line, and is supported movably in either direction along a straight path in a horizontal plane.

A machine head 100 comprises a fixed frame 101 having a front on which a needle unit 102 is supported movably in either direction along a straight path in a horizontal plane by a pair of vertically spaced apart and horizontally extending rails 103. The needle unit 102 includes a plurality of vertically disposed needle bars 104 arranged in a straight line, spaced apart horizontally from one another. Each needle bar 104 is vertically movable, and carries a needle 105 at its lower end. The fixed frame 101 includes a guide rod 106 on which a vertically movable member 108 is supported so as to be vertically movable with the rotation of a spindle 107. The vertically movable member 108 is adapted to engage an engaging member 109 projecting from one needle bar 104 selected by the motion of the needle unit 102, and thereby allow only the selected needle bar 104 and the needle 105 thereby carried to move vertically.

A pair of rearwardly extending parallel arms 110 are secured at one end to the top of the needle unit 102. A downwardly facing rack 111 extends between the other ends of the arms 110 in parallel to the rails 103. A geared motor 113 is mounted on a bracket 112 secured to the top of the fixed frame 101, and has an output shaft carrying a spur gear 114 meshing with the rack 111. A rod 115 as a means for transmitting a driving force has one end connected to one of the arms 110, while the other end thereof is connected to the color changing mechanism in the other (or another) machine head not shown.

When it has become necessary to change the needle to feed a differently colored thread, the geared motor 113 is driven, and its rotation is transmitted through the spur gear 114 to the rack 111, whereby it is converted to a straight-line motion causing the needle unit 102 to move along the rails 103. The vertically movable member 108 engages the engaging member 109 on the needle bar 104 selected by the straight-line motion of the needle unit 102, and allows only the selected needle bar 104 and the needle 105 thereby carried to move vertically.

The second embodiment of this invention makes it possible to achieve the same results as what has been described in connection with the first embodiment.

Figure 9:
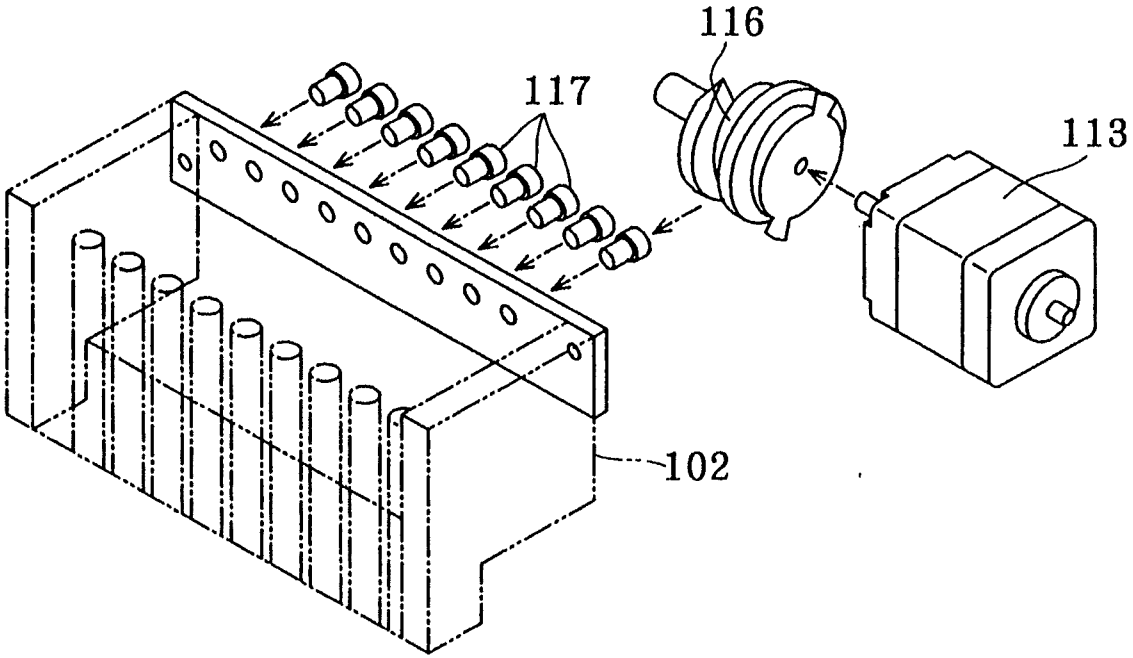
FIG. 9 is an exploded perspective view of another form of means for driving the color changing mechanism.

Modifications or variations may be made without departing from the scope and spirit of this invention. The following are a few examples of possible modifications or variations:

(1) Although the machine has been described as having two heads, the invention is equally applicable to any multi-needle embroidering machine having more than two heads;

(2) The driving means for the color changing mechanisms does not necessarily need to be incorporated in the head at one end of an array of heads, but may alternatively be incorporated in the or any intermediate head in the event that the array consists of more than two heads; and (3) FIG. 9 shows a modified form of the driving means for the color changing mechanisms in the machine according to the second embodiment. The spur gear 114 attached to the geared motor 113 in the means of FIGS. 7 and 8 is replaced by a rotatable helical grooved cam 116, and the rack 111 by a plurality of cam followers 117 arranged in a row. The alternate engagement of the cam 116 with the cam followers 117 converts the rotation of the motor 113 to a straight-line motion causing the needle unit 102 to move in either direction along a straight path in a horizontal plane.

As many apparently widely different embodiments of this invention may be made without departing from the spirit and scope thereof, it is to be understood that the invention is not limited to the specific embodiments thereof except as defined in the appended claims.

What is claimed is:

1. A multi-needle embroidering machine comprising:

a plurality of machine heads each carrying a plurality of needles;

a color changing mechanism provided in each of said heads for selecting from said needles one needle to be driven to feed a differently colored thread;

a driving means incorporated in only one of said heads for driving said mechanism of said one head and connected to said mechanism, others of said heads lacking a said driving means;

a means for transmitting a driving force from said mechanism of said one head to the color changing mechanisms of said other heads; and each said color changing mechanism comprising a needle unit including said needles, and a device for supporting said needle unit so as to be movable in a horizontal plane.

2. A machine as set forth in claim 1, wherein said needles are spaced apart from one another along an arcuate line, and said supporting device supports said needle unit rotatably in either direction in a horizontal plane.

3. A machine as set forth in claim 2, wherein said driving means comprises a motor and a device for transmitting the rotation of said motor to rotate said needle unit in either direction in a horizontal plane.

4. A machine as set forth in claim 3, wherein said motor is mounted at an upper portion of said machine head.

5. A machine as set forth in claim 3, wherein said rotation transmitting device comprises a combination of gears.

6. A machine as set forth in claim 1, wherein said needles are spaced apart from one another along a straight line, and said supporting device supports said needle unit movably in either direction along a straight path in a horizontal plane.

7. A machine as set forth in claim 6, wherein said driving means comprises a motor and a device for converting the rotation of said motor to a straight-line motion to move said needle unit in either direction along a straight path in a horizontal plane.

8. A machine as set forth in claim 7, wherein said motor is mounted at an upper portion of said machine head.

9. A machine as set forth in claim 7, wherein said converting device comprises a combination of gears.

10. A machine as set forth in claim 7, wherein said converting device comprises a rotatable helical grooved cam and a plurality of cam followers which are movable along a straight path by said cam.

11. A machine as set forth in claim 1, wherein said mechanism includes a device for locking said needle unit against movement in a desired position.

12. A machine as set forth in claim 1, wherein said driving force transmitting device comprises at least one rod.

* * * * *